US010005651B2

(12) United States Patent
Baaske et al.

(10) Patent No.: US 10,005,651 B2
(45) Date of Patent: Jun. 26, 2018

(54) IMPLEMENTS AND METHODS OF MANUFACTURING AND USING SAME

(71) Applicant: JS Innovations LLC, Schererville, IN (US)

(72) Inventors: John Baaske, Dyer, IN (US); Stacy Deming, Dyer, IN (US); Marc W. Pentecost, Valparaiso, IN (US)

(73) Assignee: JS Innovations LLC, Schererville, IN (US)

( * ) Notice: Subject to any disclaimer, the term of this patent is extended or adjusted under 35 U.S.C. 154(b) by 86 days.

(21) Appl. No.: 15/062,752

(22) Filed: Mar. 7, 2016

(65) Prior Publication Data

US 2016/0257545 A1 Sep. 8, 2016

Related U.S. Application Data

(60) Provisional application No. 62/129,361, filed on Mar. 6, 2015.

(51) Int. Cl.

| | |
|---|---|
| ***B66F 19/00*** | (2006.01) |
| ***B66F 9/18*** | (2006.01) |
| ***E02F 3/96*** | (2006.01) |
| ***E02F 5/10*** | (2006.01) |

(52) U.S. Cl.

CPC ..... *B66F 9/18* (2013.01); *E02F 3/96* (2013.01); *E02F 5/10* (2013.01)

(58) Field of Classification Search

CPC ..... B66F 19/00

USPC ..... 414/685, 722, 723, 727, 912; 37/407, 37/444

See application file for complete search history.

(56) References Cited

U.S. PATENT DOCUMENTS

| | | | | |
|---|---|---|---|---|
| 2,806,682 | A | 9/1957 | Ankershell | |
| 3,103,076 | A | 9/1963 | Schultz | |
| 3,542,435 | A | 11/1970 | Herrmann | |
| 4,164,247 | A | 8/1979 | Wolf | |
| 4,450,916 | A * | 5/1984 | Francis | A01B 27/00 172/147 |
| 4,903,418 | A | 2/1990 | London | |
| 5,628,130 | A | 5/1997 | Desrochers | |
| 5,953,839 | A * | 9/1999 | Meeks | E02F 3/963 172/247 |
| 6,146,081 | A | 11/2000 | Anderson | |
| 6,200,083 | B1 * | 3/2001 | Hein | B66F 9/19 414/607 |
| 6,287,072 | B1 * | 9/2001 | Wasilas | E02F 3/404 37/406 |
| 6,301,809 | B1 * | 10/2001 | Staggs, Jr. | E02F 3/404 37/444 |
| 6,308,440 | B1 | 10/2001 | Mueller | |
| 6,578,297 | B1 | 6/2003 | Forsberg | |
| 7,104,745 | B2 | 9/2006 | Ochoa | |

(Continued)

*Primary Examiner* — Joseph Dillon, Jr.

(74) *Attorney, Agent, or Firm* — Hartman Global IP Law; Gary Hartman; Domenica N. S. Hartman

(57) ABSTRACT

Implements for moving a first body from atop a surface includes a body configured to be removably secured to a host machine, a leading edge of the body configured to be located within a gap between the first body and the surface, and a concave curved profile above the leading edge and having a shape such that as the leading edge is forced into the gap, the curved profile contacts the first body causing the first body to roll in a direction away from the implement.

9 Claims, 10 Drawing Sheets

(56) References Cited

U.S. PATENT DOCUMENTS

| | | | | |
|---|---|---|---|---|
| 7,610,698 | B2 | 11/2009 | May | |
| 7,695,214 | B2 | 4/2010 | Mailand | |
| 7,793,443 | B2 * | 9/2010 | Galbreath | E02F 3/401 37/408 |
| 8,157,473 | B2 | 4/2012 | Johnson | |
| 8,464,443 | B2 * | 6/2013 | Torgrimsen | E02F 9/2883 172/701.3 |
| 8,745,903 | B1 | 6/2014 | Ritter | |
| 8,827,627 | B2 * | 9/2014 | Landry | E02F 3/04 37/443 |
| 9,015,970 | B1 * | 4/2015 | Doucette | E02F 3/404 37/444 |
| 2004/0253088 | A1 * | 12/2004 | Sweningson | E02F 3/404 414/723 |
| 2005/0069405 | A1 * | 3/2005 | McGinnes | A01D 87/127 414/722 |
| 2005/0126057 | A1 * | 6/2005 | Currey | E02F 3/40 37/444 |
| 2006/0182590 | A1 * | 8/2006 | McFarland | E02F 3/40 414/685 |
| 2010/0000129 | A1 * | 1/2010 | Balemi | E02F 3/3677 37/444 |
| 2012/0301257 | A1 * | 11/2012 | Seljestad | E02F 3/404 414/722 |
| 2015/0233084 | A1 * | 8/2015 | Seljestad | E02F 3/3663 414/723 |
| 2016/0251821 | A1 * | 9/2016 | Yoshida | E02F 3/40 414/685 |

* cited by examiner

IMPLEMENTS AND METHODS OF MANUFACTURING AND USING SAME

CROSS REFERENCE TO RELATED APPLICATIONS

This application claims the benefit of U.S. Provisional Application No. 62/129,361, filed Mar. 6, 2015, the contents of which are incorporated herein by reference.

BACKGROUND OF THE INVENTION

The present invention generally relates to construction equipment and methods. The invention particularly relates to implements and methods for moving heavy objects, as a nonlimiting example, a concrete section cut from a slab.

Situations occur in which it is desirable to remove a portion of a concrete structure after it has cured. For example, portions of a concrete slab of a building foundation, or the like must often be removed to provide for installation of underground plumbing, electrical wiring, etc. Concrete removal often involves breaking, hammering, and/or demolishing the concrete to produce relatively small chunks which may be individually removed by hand. In the case of forming a trench in a concrete slab, the slab is typically cut with a cutting saw or equivalent machine. The resulting one or more concrete sections that must be moved from the trench are a relatively large pieces of concrete with little if any gaps or clearances on sides or at either end that would facilitate their removal. Consequently, concrete removal can be difficult and even hazardous if done by hand.

As an alternative, a section cut from a concrete slab may be removed with industrial equipment, such as a forklift or a loader equipped with a bucket. During removal, the fork blades of a forklift or an edge of a loader bucket may be slowly wedged into any gap or clearance beneath the cut section or otherwise forced under the section so that it can be lifted from the trench. However, loaders and forklifts have several limitations. For example, fork blades on a forklift may be a fixed distance apart or have limited adjustability. Consequently, a forklift may be difficult to use when removing concrete cut sections of lengths that are less that the distance between the fork blades. Additionally, both loaders and forklifts rely on a lifting action to remove the cut section. If the concrete section being removed is dropped, the surrounding environment may be damaged and/or workers may be injured. Furthermore, tension between the loader or forklift and the section being removed may cause a spring-like action if the section is dropped. Such a situation can result in portions of the cut section being propelled and stiking nearby objects or bystanders. Additionally, if portions of the cut section break off during the lifting process, injuries may occur from airborne concrete fragments.

In view of the above, it can be appreciated that it would be desirable if improved equipment and methods were available for removal of concrete sections and other large heavy objects having limited clearance from which the object can be safely lifted.

BRIEF DESCRIPTION OF THE INVENTION

The present invention provides implements and methods for moving heavy objects having limited clearances from which the objects can be safely lifted, and methods of manufacturing such implements.

According to one aspect of the invention, an implement for moving a first body from atop a surface includes a body configured to be removably secured to a host machine, a leading edge of the body configured to be located below the first body or within a gap between the first body and the surface, and a concave curved profile above the leading edge and having a shape such that as the leading edge is forced below the first body or into the gap, the curved profile contacts the first body causing the first body to roll in a direction away from the implement.

According to another aspect of the invention, an implement includes a body having first and second ends oppositely disposed along a longitudinal axis of the body. The body includes an upper flange, a lower flange, and a web therebetween that is transverse to and interconnects the upper and lower flanges. The lower flange extends farther in a lengthwise direction of the body at the second end thereof than the upper flange so as to define a leading edge of the body at the second end thereof. The lower flange has a surface that is perpendicular to the web and defines a lowermost extent of the leading edge. The implement includes means at the first end of the body for removably coupling the body to a host machine, and a concave curved profile defined by the web at the second end of the body between the upper and lower flanges. The concave curved profile extends farther in the lengthwise direction of the body at the lower flange than at the upper flange.

According to another aspect of the invention, an implement includes a body having first and second ends oppositely disposed along a longitudinal axis of the body. The body includes an upper flange, at least one lower flange, and a plate therebetween that is transverse to and interconnects the upper and lower flanges. The implement includes a concave curved profile defined by the plate at the second end of the body between the upper and lower flanges. The concave curved profile extending farther in the lengthwise direction of the body at the at least one lower flange than at the upper flange. The implement includes an elongated sleeve secured to the body and having a tip that extends away from the second end of the body, and means at the first end of the body for removably coupling the body to a host machine.

Other aspects of the invention includes methods for fabricating and methods for using the above described implements.

An example of a method of fabricating an implement includes providing an elongated I-beam having first and second flanges and a web therebetween, a longitudinal axis, and oppositely-disposed ends along the longitudinal axis, securing a mounting plate to a first of the oppositely-disposed ends of the I-beam, and cutting a second of the oppositely-disposed ends to define a concave curved profile in the web and to remove a greater portion of the first flange of the I-beam than the second flange of the I-beam so that the second flange extends farther in a lengthwise direction of the I-beam than the first flange, the second flange defines a leading edge of the implement, and the concave curved profile extends farther in the lengthwise direction at the second flange than at the first flange.

An example of a method of using the an implement includes moving a first body resting on a second body to define a gap therebetween includes providing an implement comprising a concave curved profile at one end thereof such that the concave curved profile extends farther in a lengthwise direction of the implement at a lower extent thereof than at an upper extent thereof, and the lower extent of the implement defines a leading edge of the implement. The method includes removably coupling the implement to a host machine, and forcing the leading edge of the body into the gap such that the leading edge is positioned between an outermost edge of the first body and an outermost edge of the second body, and the outermost edge of the first body contacts the concave curved profile and slides along the concave curved profile in a direction towards the upper extent of the implement. The leading edge is continued to be forced into the gap until the first body is rolled in a direction away from the implement thereby exposing a surface of the second body previously located beneath the first body.

An example of a method of using the an implement includes moving a first body out of a trench defined by at least a second body includes providing an implement comprising a concave curved profile at one end thereof, the concave curved profile extending farther in a lengthwise direction of the implement at a lower extent thereof than at an upper extent thereof, and the lower extent of the implement defining a leading edge of the implement. The method includes removably coupling the implement to the host machine, and forcing the leading edge of the implement between the first body and a surface on which the first body rests such that the leading edge is positioned directly below an outermost edge of the first body, and the outermost edge of the first body contacts the concave curved profile and slides along the concave curved profile in a direction towards the upper extent of the implement. The leading edge is continued to be forced between the first body and the surface until the first body is rolled in a direction away from the implement and out of the trench.

A technical effect of the invention is the ability to remove a portion of a heavy material from a surface on which it rests, particularly when there is limited access to edges of the portion. In particular, it is believed that by providing an implement having a leading edge shaped to be located between a portion to be moved and a surface upon which it rests, and a concave curved profile adjacent and above the leading edge, the implement may be operated to force the leading edge into a gap between the portion and the surface on which it rests, force the portion upwards along the curved profile, and thereby eventually cause the portion to roll or flip off of the surface on which it rests.

Other aspects and advantages of this invention will be better appreciated from the following detailed description.

DETAILED DESCRIPTION OF THE INVENTION

The present invention is generally applicable to equipment and methods for moving or removing of heavy objects, such as a portion of concrete cut from a larger body of concrete. Aspects of the invention are described hereinafter in reference to an implement suitable for moving a section of concrete, for example, cut from a concrete slab of a building foundation or the like. However, it will be clear to those of ordinary skill in the art that the implement may be used for moving and removing heavy objects other than concrete. To facilitate the description of the implement provided below, the terms "vertical," "horizontal," "lateral," "front," "rear," "side," "forward," "rearward," "upper," "lower," "above," "below," "right," "left," etc., will be used in reference to the orientation of the implement as depicted in FIG. 4, and therefore are relative terms that indicate the construction, installation, and use of the invention and therefore help to define the scope of the invention.

Figure 1:
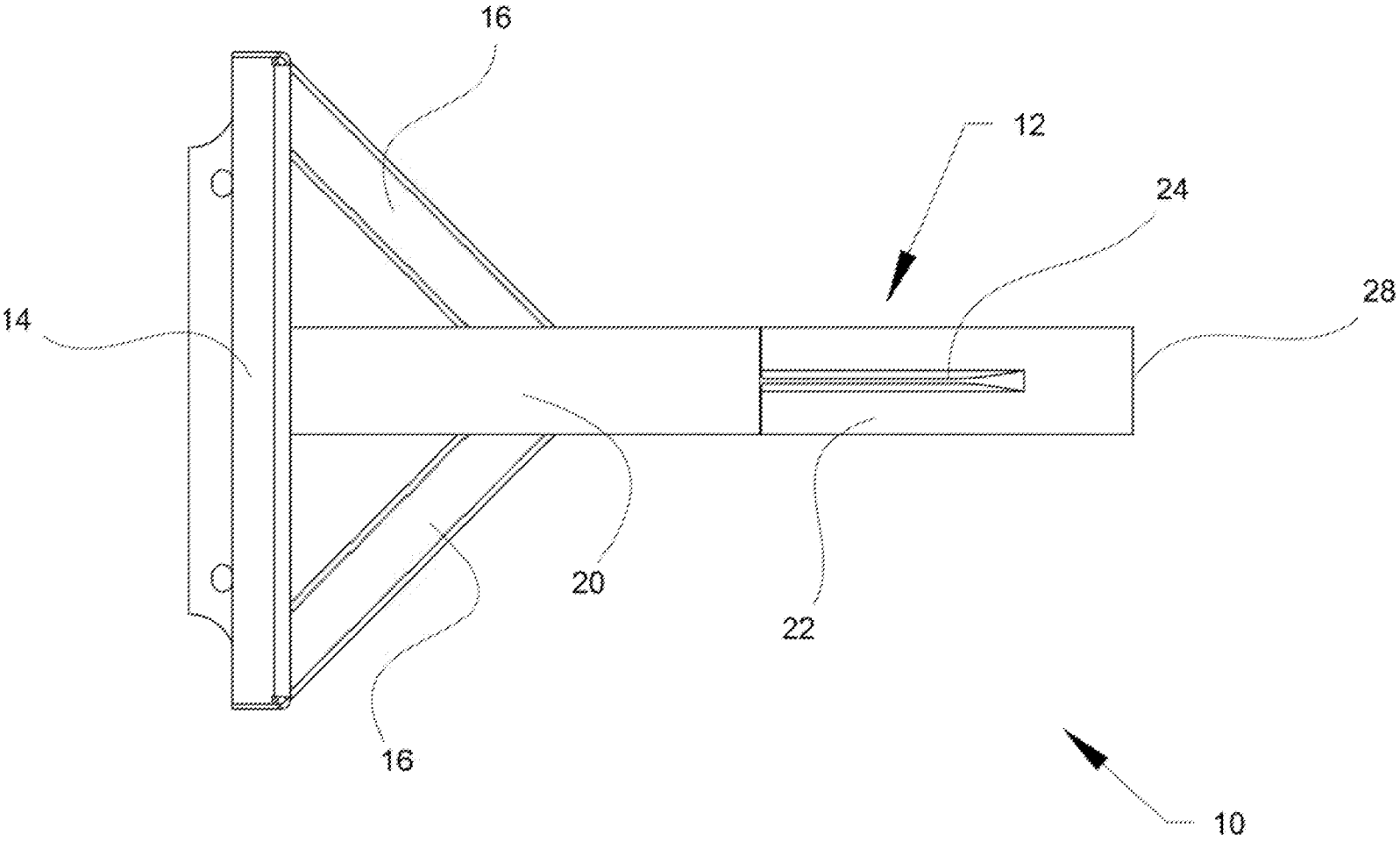
FIGS. 1 through 3 represent top, side, and end views, respectively, of a first nonlimiting embodiment of an implement in accordance with certain aspects of this invention.
Figure 2:
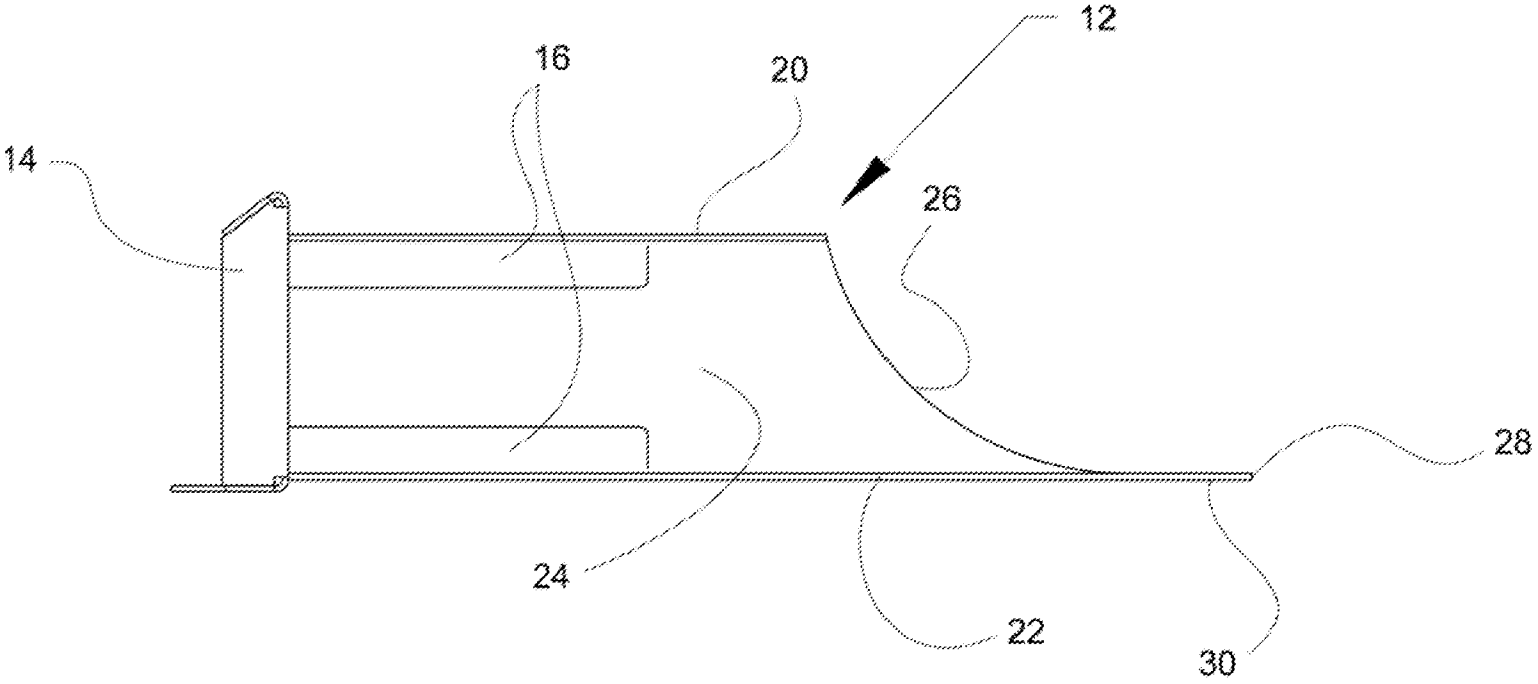
Figure 3:
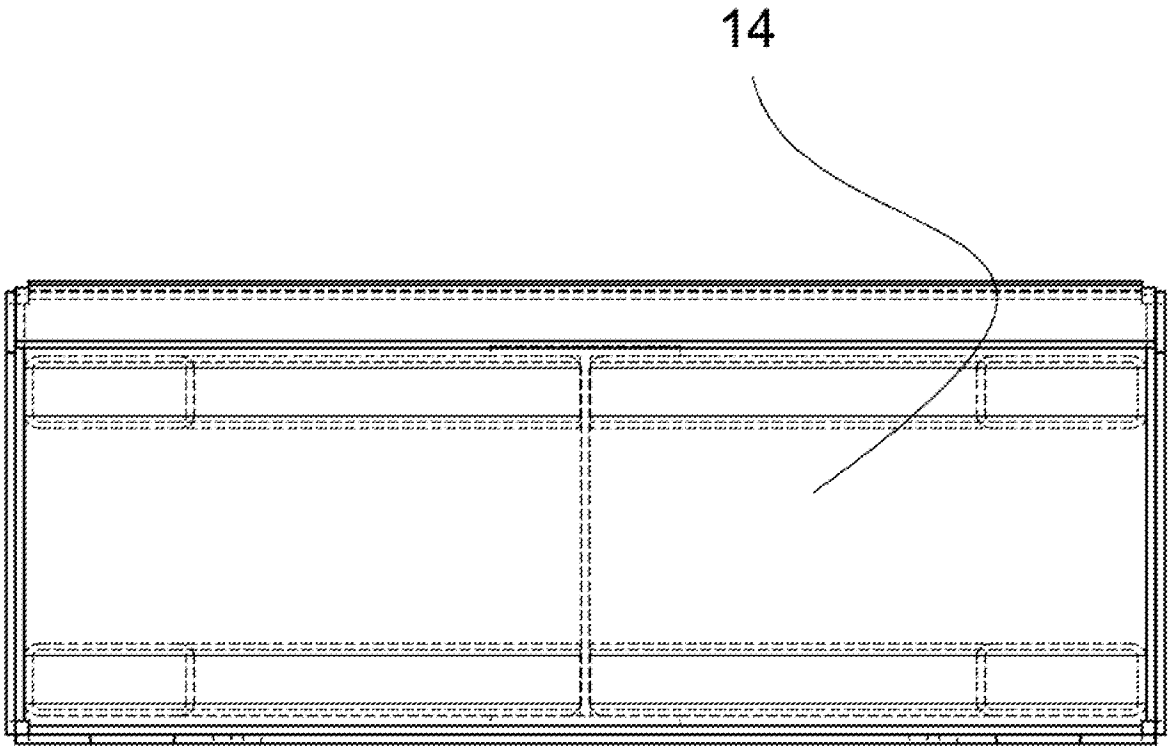

FIGS. 1 through 3 represent the implement 10 as comprising a body 12 secured to a mounting plate 14, and whose attachment to the plate 14 is reinforced with gussets or supporting members 16. The body 12 includes an upper flange 20, a lower flange 22, and a web 24 therebetween that is transverse to the flanges 20 and 22 and interconnects the flanges 20 and 22 to each other. A first end of the body 12 is represented as being secured to the mounting plate 14 such that corresponding ends of the upper flange 20, the lower flange 22, and the web 24 are directly attached to the mounting plate 14. The body 12 has a second end oppositely-disposed from the first end along a longitudinal axis of the body 12. The lower flange 22 extends a greater distance at the second end of the body 12 than the upper flange 20 in a lengthwise direction along the longitudinal axis of the body 12. The second end of the body 12 includes a concave, curved profile 26 largely defined by the web 24 and extending from an uppermost portion thereof adjacent the upper flange 20 to a lowermost portion thereof adjacent a leading edge 28 of the implement 10 defined by the lower flange 22 at the second end of the body 12. For example, FIG. 2 represents the lowermost portion of the curved profile 26 as defining an acute angle with the lower flange 22, the uppermost portion of the curved profile 26 as defining an angle that approaches but is preferably less than ninety degrees to the lower flange 22, and the curved profile 26 as having a degree of curvature of not greater than ninety degrees and preferably less than ninety degrees. The shape and orientation of the profile 26 are such that the profile 26 extends a greater distance at the lower flange 22 than at the upper flange 20 in the lengthwise direction of the body 12. The curved profile 26 may be entirely within the web 24 between the upper flange 20 and the lower flange 22, for example, so that the portion of the lower flange 22 that defines the leading edge 28 extends in the lengthwise direction beyond the web 24 and the leading edge 28 has a flat horizontal profile as shown in FIGS. 1, 2 and 3. Alternatively, the curved profile 26 may be entirely within the web 24 and terminate within the web 24 above the lower flange 22, for example, so that an end portion of the web 24 remains at the end of the body 12 and the leading edge 28 of the implement 10 has an inverted T-shaped profile as shown in FIGS. 5-9. Finally, the profile 26 could be continuous through the upper and/or lower flanges 20 and 22, such that the concave curvature is also present in one or both of the ends of the flanges 20 and 22. In any event, the lowermost extent of the leading edge 28 is preferably defined by a flat lower surface 30 of the lower flange 22 that is preferably perpendicular to the web 24.

Figure 4:
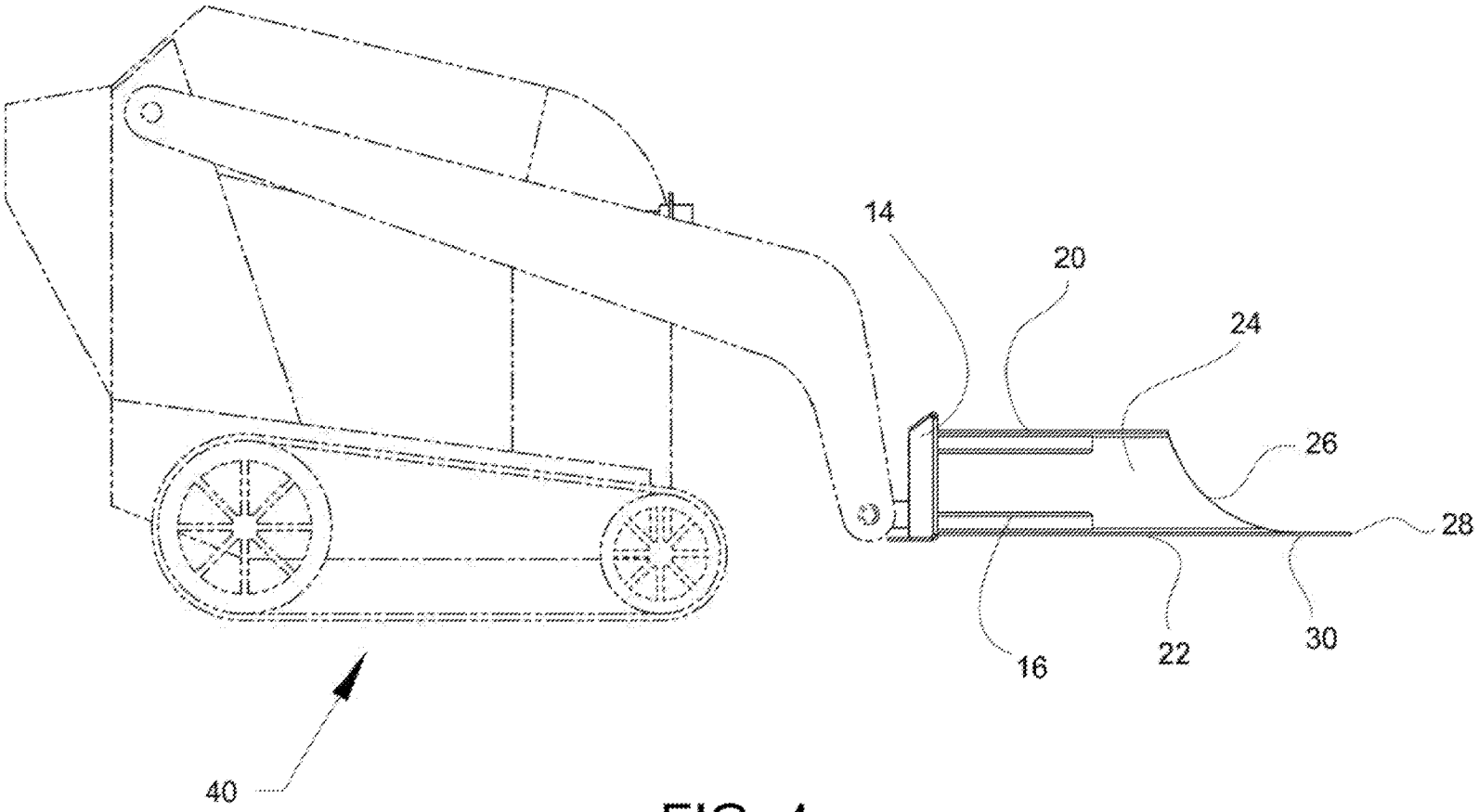
FIG. 4 represents a side view of the implement of FIG. 1 coupled to an industrial vehicle.
Figure 5:
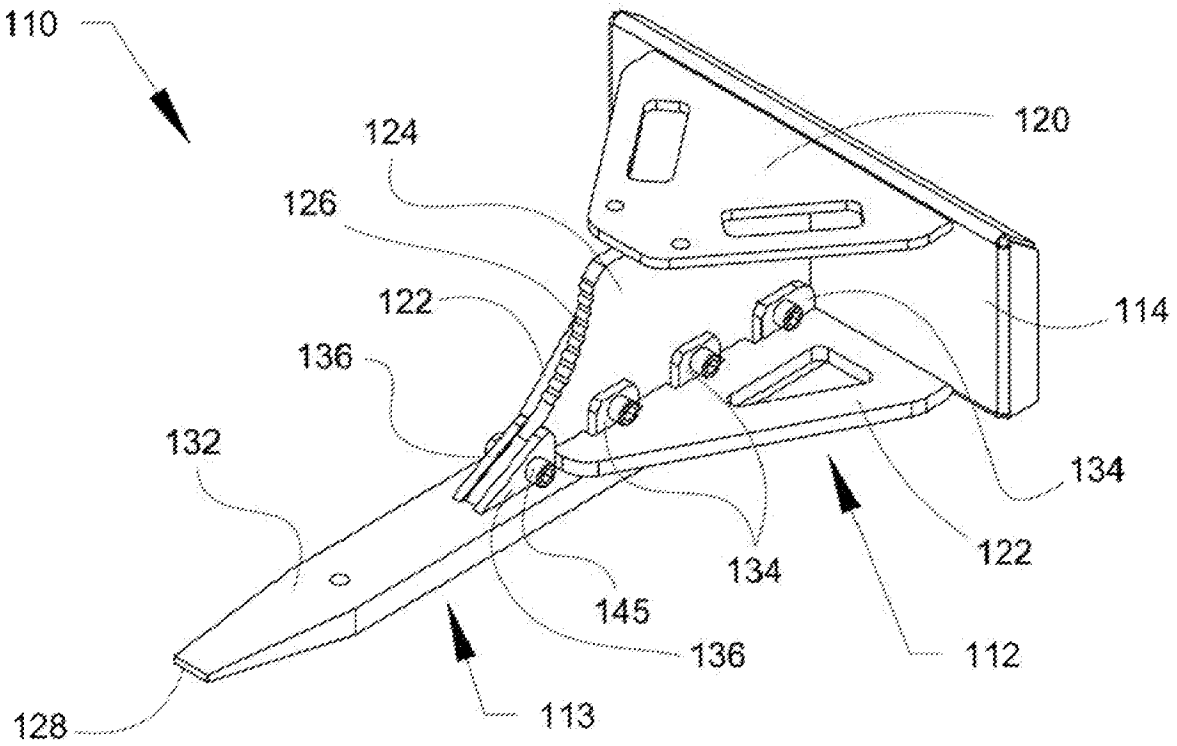
FIG. 5 represents a perspective view of a second nonlimiting embodiment of an implement in accordance with certain aspects of this invention.

The mounting plate 14 may be of any shape suitable for removably coupling the implement 10 to a host machine 40 (for example, a motorized utility vehicle) as represented in FIG. 4. The mounting plate 14 may be a universal mounting plate that is suitable for individually coupling with a plurality of types of host machines, or may be a mounting plate or other type of connection configured to couple with a specific brand or type of host machine.

The structural integrity of the body 12 may be improved by securing the supporting members 16 between the mounting plate 14 and the body 12. FIGS. 1 through 4 represent the implement 10 as including a total of four rectangular tube-shaped supporting members 16 with two of the four supporting members 16 located on each side of the web 24. Each supporting member 16 has a first end secured to the mounting plate 16 and a second end secured to the web 24 thereby providing additional support to the body 12 that promotes the rigidity of the body 12 and the implement 10 as a whole. It should be understood by those skilled in the art that the supporting members 16 function to distribute forces placed on the body 12 over a larger surface area of the mounting plate 14 than the limited area of the body 12 in direct contact with the mounting plate 14. As such, the supporting members 16 may be of any shape, size, or number suitable for reinforcing the body 12 relative to the mounting plate 14.

Figure 8:
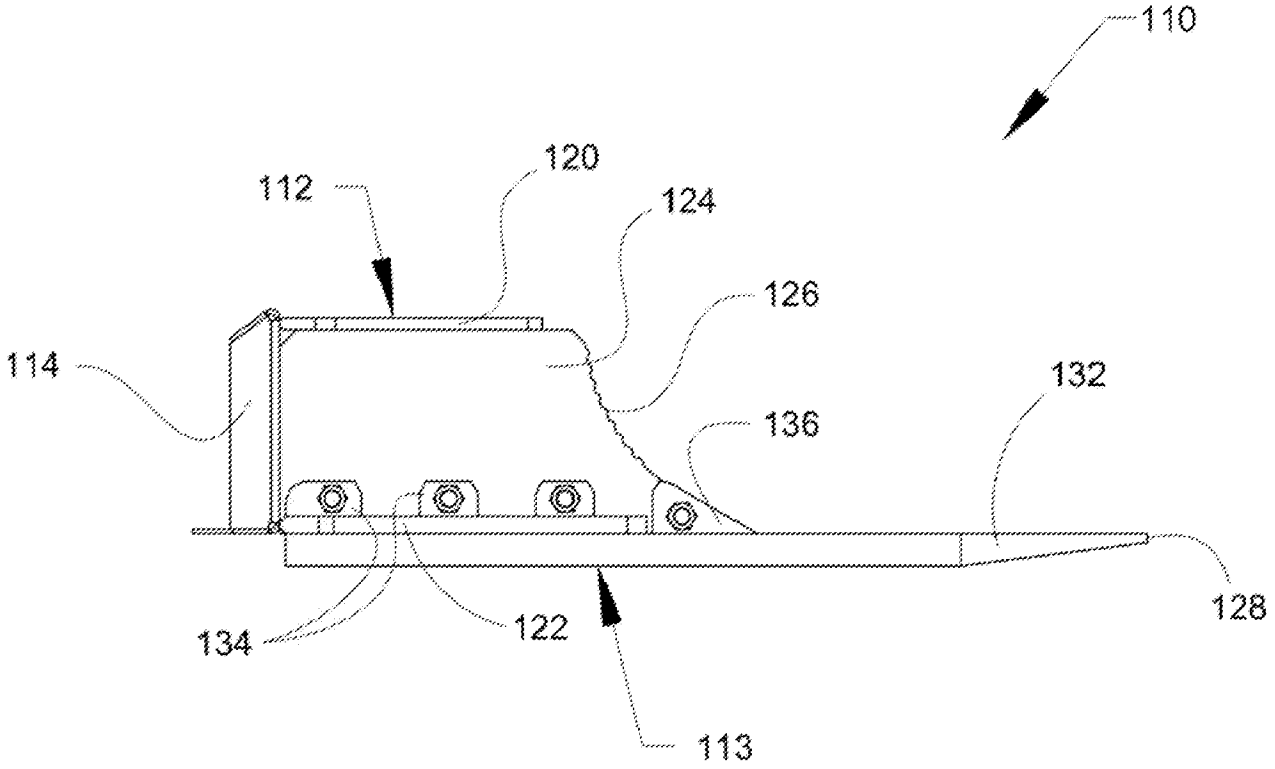
Figure 9:
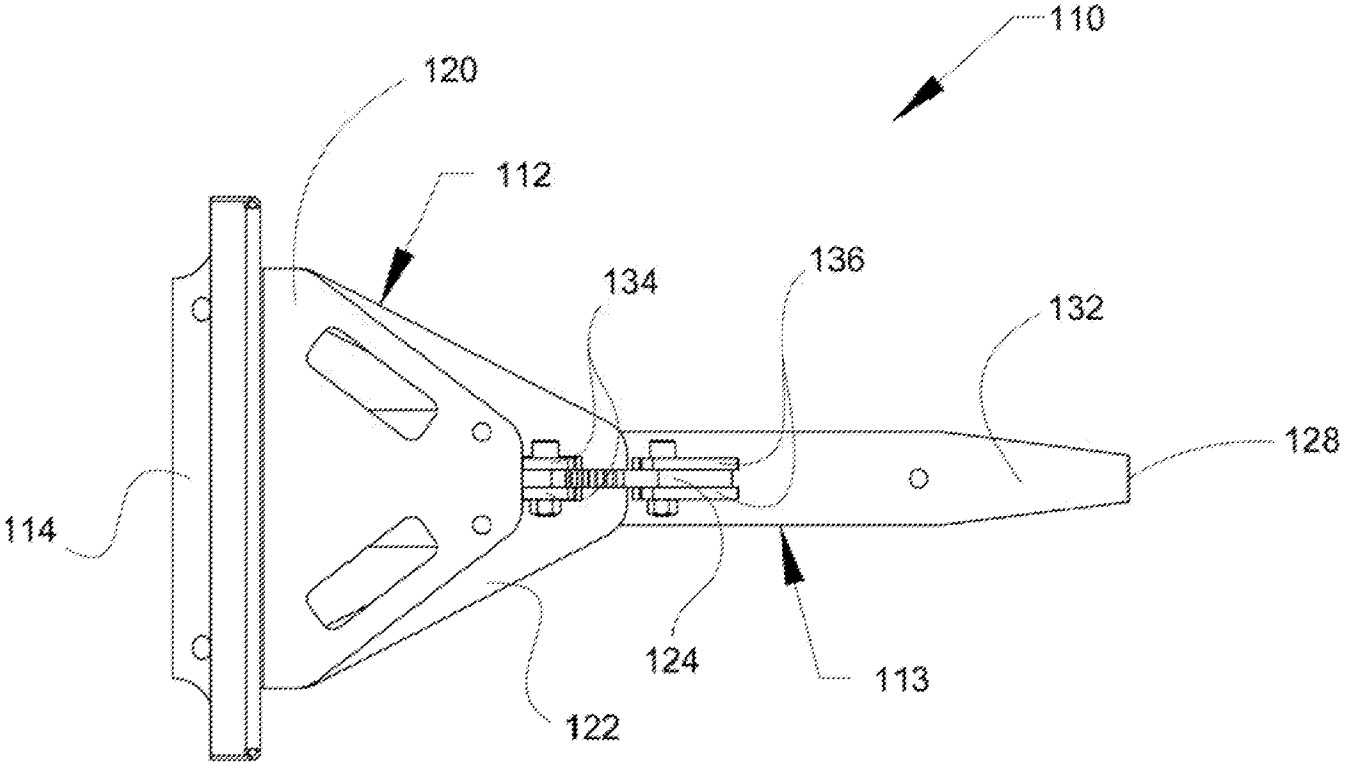

FIGS. 5 through 9 represent an alternative implement 110 having substantially the same functionality as the implement 10. The implement 110 comprises an assembly of a body 112 and a sleeve 113. The body 112 includes an upper flange 120, two lower flanges 122, and a curved plate 124 therebetween that is transverse to the flanges 120 and 122 and interconnects the flanges 120 and 122 together. A first end of the body 112 is represented as being secured to a mounting plate 114 such that corresponding ends of the upper flange 120, lower flanges 122, and the curved plate 124 are directly attached to the mounting plate 114. The mounting plate 114 may have substantially similar structure and functionality as the mounting plate 14, and therefore will not be described further. The body 112 has a second end oppositely-disposed from the first end along a longitudinal axis of the body 112. The lower flanges 122 may optionally extend a greater distance at the second end of the body 112 than the upper flange 120 in a lengthwise direction along the longitudinal axis of the body 112. The second end of the body 112 includes a concave, curved profile 126 solely defined by the curved plate 124 and preferably extending from an uppermost portion thereof adjacent the upper flange 120 to a lowermost portion thereof adjacent the sleeve 113. As a nonlimiting example, FIG. 8 represents the lowermost portion of the curved profile 126 as defining an acute angle with the sleeve 133, the uppermost portion of the curved profile 126 as defining an angle that approaches but is preferably less than ninety degrees to the sleeve 113, and the curved profile 126 as having a degree of curvature that is not greater than ninety degrees and preferably less than ninety degrees. The shape and orientation of the profile 126 are such that the profile 126 extends a greater distance at the lowermost portion of the curved plate 124 than at the uppermost portion thereof in the lengthwise direction of the body 112. An edge defining the curved profile 126 of the curved plate 124 may be relatively smooth or may optionally include surface features in order to modify the functionality of the profile 126. For example, FIGS. 5 through 9 represent the edge as being serrated or having a plurality of rounded protrusions thereon. Preferably, any surface features included on the edge of the curved profile 126 of the curved plate 124 allow an object to slide upwards on the edge during use of the implement 110, and may promote friction between the implement 110 and the object in order to provide additional grip and control when flipping, overturning, or rolling the object such that the object is less likely to slide downwards on the edge.

Figure 6:
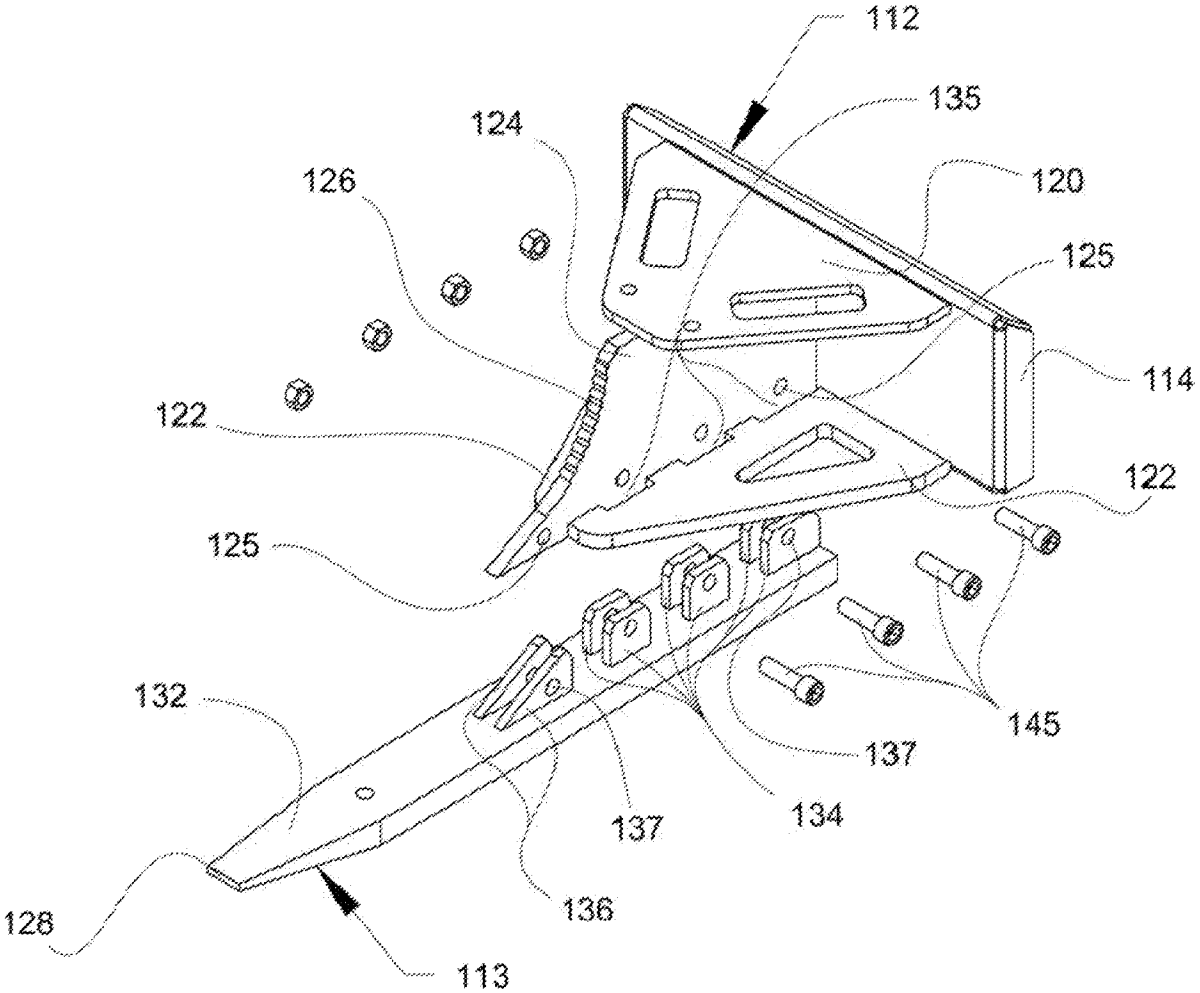
FIG. 6 represents an exploded view of the implement of FIG. 5.
Figure 7:
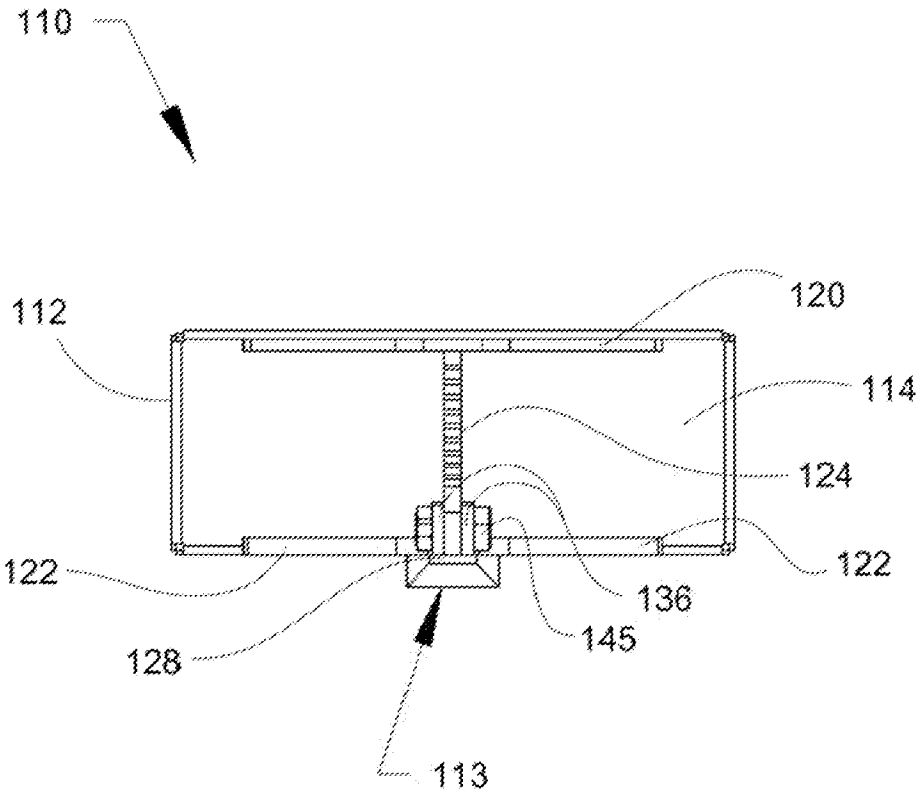
FIGS. 7 through 9 represent end, side, and top views of the implement of FIG. 5.

The sleeve 113 may be secured to a lowermost portion of the body 112 and protrudes from the second end of the body 112 to define a leading edge 128 of the implement 110. As represented in FIG. 6, the sleeve 113 is preferably removable from the body 112. This provides the beneficial capability of replacing a damaged sleeve 113 rather than replacing the entire implement 110. In addition, it is foreseeable and within the scope of the invention that sleeves 113 having structures other than that shown in FIG. 6 may be used. For example, a tip 132 of the sleeve 113 may have any suitable shape and construction. For example, it may be desirable to attach a sleeve 113 to the body 112 that comprises a ninety degree downward bend near the leading edge 128 thereof such that the implement 110 may be used to pull, separate, or lift objects in a tight space. Preferably, various types of sleeves 113 may be removably secured to the body 112 depending on the desired application.

FIG. 6 represents the sleeve 113 as comprising flanges 134 and 136. The flanges 134 are sized and shaped to be inserted into passages 135 through the lower flanges 122 such that a portion of each of the flanges 134 protrudes above the lower flanges 122. The flanges 134 and 136 include through holes 137 that correspond in location to through holes 125 in the curved plate 124 such that when the sleeve 113 and the body 112 are assembled as previously described, fasteners 145 may be inserted through the through holes 125 and 137 in order to secure the sleeve 113 to the body 112. The flanges 136 are represented as having an angled profile on a first side thereof that corresponds in slope to the profile 126 of the curved plate 124. As such, the flanges 136 preferably do not interfere with the function of the profile 126, and may further reinforce a lowermost portion of the profile 126. It should be understood that the sleeve 113 may be secured to the body 112 by any means, and may optionally be permanently secured or removably secured thereto.

Figure 10B:
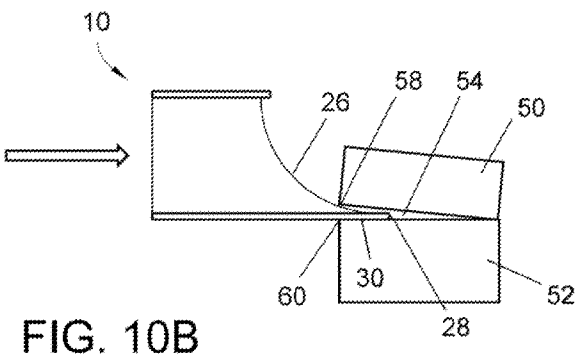
FIGS. 10A through 10E represent steps of a method of using an implement in accordance with an aspect of this invention.
Figure 10D:
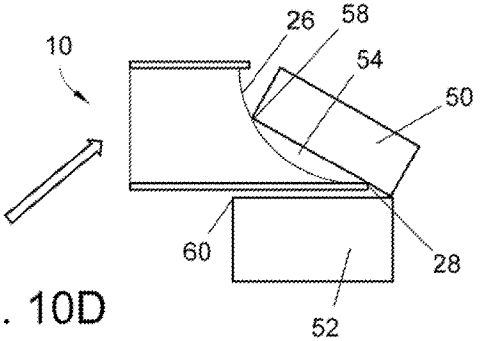
Figure 10A:
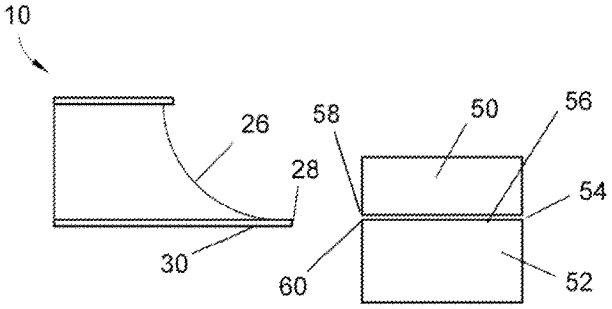
Figure 10C:
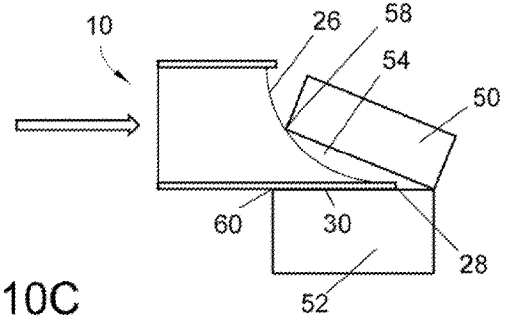
Figure 10E:
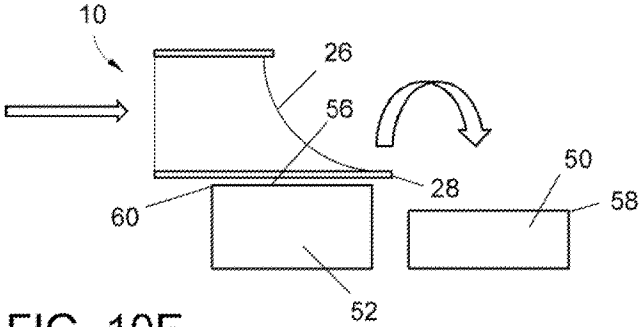

FIGS. 10A through 10E depict exemplary non-limiting steps involved in the use of the implement 10 to move a heavy object, for example, a concrete section 50 of concrete resting on a surface 52. Prior to use, the implement 10 may be securely, yet removably, coupled to the host machine 40 via the mounting plate 14. In order to move the section 50, the host machine 40 may be operated to locate the leading edge 28 of the body 12 below the section 50 between the section 50 and surface 52 (FIG. 10A). The leading edge 28 may be worked or moved by the host machine 40 below the section 50 into a gap 54 such that an end portion of the lower flange 22 is positioned between outermost edges 58 and 60 of, respectively, the section 50 and surface 52, and the flat lower surface 30 of the lower flange 22 traverses a relatively flat and smooth upper portion 56 of the surface 52 below the section 50 (FIG. 10B). If contact or damage to the surface 52 is not a concern, for example, if the surface 52 is dirt or the like, the implement 10 may be partially inserted into the surface 52 if necessary. As the leading edge 28 is worked below the section 50, the outermost edge 58 of the section 50 preferably contacts the curved profile 26 of the web 24 and slides upward along the curved profile 26 towards the upper flange 20 (FIGS. 10B and 10C). As the outmost edge 58 of the section 50 slides upwards, the gap 54 between the section 50 and surface 52 increases and the section 50 rotates in a direction way from the surface 52 and the lower flange 22 of the body 12. Preferably, this motion continues until the section 50 rotates to a point at which the section 50 flips over or is rolled in a direction away from the implement 10, thereby exposing the portion 56 of the surface 52 that was previously below the section 50 (FIG. 10E). As depicted in FIG. 10D, in some embodiments the host machine 40 can be used to lift the implement 10 upward during the process in order to further promote flipping or rolling of the section 50. Preferably, the portion of the lower flange 22 that defines the leading edge 28 extends in the lengthwise direction beyond the web 24 and the leading edge 28 has a flat horizontal profile for the purpose of lifting the section 50. Once the section 50 has been moved to expose the portion 56 of the surface 52, the section 50 may be more easily accessed and removed by hand or with other industrial equipment. Although the above process is described in reference to the implement 10 of FIGS. 1 through 4, it should be understood that the implement 110 of FIGS. 5 through 9 is also capable of performing such process.

Although FIGS. 10A through 10E depict the surface 52 as being elevated above the surrounding environment, it is within the scope of the invention that the surface 52 may be level with or may be located below the surrounding environment. For example, the implement 10/110 may be used to remove sections cut from a concrete slab to form a trench in the slab. The sections may be individually flipped or rolled on the ground or surface within the trench of the slab in a manner similar to that described in reference to FIGS. 10A through 10E in order to at least partially remove each the sections from the trench one at a time. During investigations leading to the present invention, it was found that the rolling motion caused by the implement 10/110 would either cause a concrete section being worked upon to roll against another section in line along the trench such that the concrete section being worked upon would roll upwards and out of the trench, or would cause the concrete section to roll upright. If the concrete section was left standing upright, the leading edge 28/128 may be used to push the concrete section out of the trench, or the leading edge 28/128 may be located below a lowermost portion of the concrete section which remains resting on the surface within the trench to again cause the rolling motion such that the concrete section rolls out of the trench. By using this method, it was found that subsequently located concrete sections along the trench could be quickly and safely removed one after another.

Unlike conventional loaders and forklifts, the implement 10/110 does not rely solely on an upward force to lift and remove a concrete section. Instead, the implement 10/110 induces an upward and forward motion (away from the implement 10/110) to flip or roll the section away from the surface below. As such, there is no requirement that the cut section be entirely lifted off of the surface on which the disposable portion rests in order to remove the curb section. Consequently, it is believed that the risk of injury to personnel and damage to the surroundings from the cut section falling, breaking, or ejecting chips or chunks are greatly reduced.

The implement 10/110 may be formed of any materials of sufficient strength and rigidity to move concrete or other heavy objects. According to an aspect of the invention, the body 12 of implement 10 may be formed by cutting a conventional steel I-beam, whose flanges are cut to define the upper and lower flanges 20 and 22 of the implement 10 and whose web serves as the web 24 of the implement 10 and is cut to define the curved profile 26. The end of the I-beam opposite the profile 26 is cut roughly perpendicular to the longitudinal axis of the beam to define the end of the body 12 that can then be welded or secured by other suitable means to the mounting plate 14. Preferably, the I-beam is formed of hardened steal or the implement 10 is otherwise treated subsequent to manufacture to strengthen the material of the body 12. The implement 10 may include reinforcing members in addition to those represented in the figures and described herein in order to further strengthen the implement 10.

While the invention has been described in terms of specific embodiments, it is apparent that other forms could be adopted by one skilled in the art. For example, the physical configuration of the implements 10/110 and their components could differ from that shown, and materials and processes/methods other than those noted could be used. Therefore, the scope of the invention is to be limited only by the following claims.

The invention claimed is:

1. An implement for moving a first body from atop a surface, the implement comprising:

a body configured to be removably secured to a host machine;

a leading edge of the body configured to be forced beneath the first body or within a gap between the first body and the surface; and a concave curved profile above the leading edge and having a lowermost portion defining an acute angle with the leading edge and an uppermost portion defining an angle that approaches ninety degrees to the leading edge, the concave curved profile having a degree of curvature of not greater than ninety degrees and having a shape such that as the leading edge is forced below the first body or into the gap, the curved profile contacts the first body causing the first body to roll in a direction away from the implement.

2. The implement of claim 1, wherein the concave curved profile extends farther in a lengthwise direction of the body at the leading edge.

3. An implement comprising:

a body having first and second ends oppositely disposed along a longitudinal axis of the body, the body comprising an upper flange, at least one lower flange, and a plate therebetween that is transverse to and interconnects the upper and lower flanges;

an elongated sleeve secured to the body and having a tip that extends away from the second end of the body;

a concave curved profile defined by the plate at the second end of the body between the upper and lower flanges, the concave curved profile extending farther in the lengthwise direction of the body at the lower flange than at the upper flange, the concave curved profile having a lowermost portion defining an acute angle with the sleeve and an uppermost portion defining an angle that approaches ninety degrees to the sleeve, the concave curved profile having a degree of curvature of not greater than ninety degrees; and means at the first end of the body for removably coupling the body to a host machine.

4. The implement of claim 3, wherein the sleeve is secured to a lowermost portion of the body and defines a leading edge having a flat horizontal profile that extends in the lengthwise direction beyond the plate.

5. The implement of claim 3, wherein the sleeve is removably secured to the body.

6. The implement of claim 3, wherein the sleeve includes at least one flange located through at least one passage in the lower flange such that a portion of the flange of the sleeve protrudes through the lower flange.

7. The implement of claim 6, wherein the flange of the sleeve comprises means for removably securing the sleeve to the body.

8. The implement of claim 3, wherein the sleeve comprises means for reinforcing a lowermost portion of the concave curved profile of the plate.

9. The implement of claim 3, wherein the concave curved profile comprises surface features thereon.

* * * * *